United States Patent [19]

Schmitt

[11] 3,972,016

[45] July 27, 1976

[54] THERMOSTAT

[75] Inventor: Donald J. Schmitt, Mansfield, Ohio

[73] Assignee: Therm-O-Disc Incorporated, Mansfield, Ohio

[22] Filed: June 28, 1974

[21] Appl. No.: 483,924

[52] U.S. Cl. ..... 337/354; 337/365; 337/372; 337/380

[51] Int. Cl.[2] ..... H01H 37/52

[58] Field of Search ..... 337/343, 348, 354, 355, 337/365, 372, 380, 381, 396

[56] References Cited

UNITED STATES PATENTS

| | | | |
|---|---|---|---|
| 2,991,341 | 7/1961 | Ulanet | 337/372 X |
| 3,067,306 | 12/1962 | Epstein | 337/365 |
| 3,470,518 | 9/1969 | Schmitt | 337/348 X |

FOREIGN PATENTS OR APPLICATIONS

| | | | |
|---|---|---|---|
| 1,061,865 | 3/1967 | United Kingdom | 337/372 |

*Primary Examiner*—Donovan F. Duggan
*Assistant Examiner*—Fred E. Bell
*Attorney, Agent, or Firm*—McNenny, Pearne, Gordon, Gail, Dickinson & Schiller

[57] ABSTRACT

A structurally simple thermostat is disclosed in which a single rivet provides the mounting of all of the switch elements. The switch elements are located by the rivet and by a portion of the contacts substantially spaced from the rivet to minimize the affect of manufacturing tolerances in the positioning of the switch elements. A single terminal element supports the movable contact, provides a terminal extension and closes the switch cavity. The structure is arranged so that ceramic material can be used for the non-metallic parts with a minimum effect created by the relatively loose dimensional tolerances required in the manufacture of ceramic parts. The terminal member is formed with a shallow dish shaped projection which prestresses the rivet assembly to prevent looseness resulting from differential expansion.

9 Claims, 4 Drawing Figures

THERMOSTAT

BACKGROUND OF THE INVENTION

This invention relates generally to thermostatic devices and more particularly to a novel and improved thermostat structurally arranged to require a minimum number of parts, and to provide simplicity of manufacture and assembly while maintaining durability and reliability in operation.

PRIOR ART

In my U.S. Pat. No. 3,470,518, assigned to the assignee of the present invention, a structurally simple thermostat is disclosed.

SUMMARY OF THE INVENTION

The present invention is an improvement on the thermostat disclosed in my prior patent, supra, and such patent is incorporated herein by reference. In the illustrated embodiment of the present invention, the structure is arranged to require a minimum number of parts which can be easily fabricated. Further, the structure is arranged to facilitate easy assembly of the thermostat and to insure that it will be durable and reliable in operation.

With the present invention, non-metal parts of the device can be conveniently manufactured from ceramic material so that the thermostat can be used in environments in which elevated temperatures are encountered. The dimensional tolerances required in ceramic parts are normally substantially larger than the tolerances which can be maintained when the parts are made of conventional plastics. Therefore, the precise positioning of the various thermostat elements on a ceramic body is more difficult. In the illustrated embodiment, the various structural elements are arranged to provide good positioning control of the various parts on the main body even though the dimensional tolerances of the body may be relatively large.

The various switch elements are all secured to a body by a single rivet which determines the position of one part of each switch element with respect to the body. A second portion of the switch elements is positioned by the body at a location substantially spaced from the mounting rivet so that the effect of dimensional variations in the body have a minimal effect on the positioning of the switch elements.

In the particular embodiment illustrated, the main thermostat body is formed with an open switch cavity and is provided with a switch mounting projection adjacent thereto. An elongated fixed contact extends from the mounting portion to an inner end on the opposite side of the cavity. Its outer end provides a terminal portion exterior of the body.

An elongated movable contact assembly includes a relatively thick terminal member which also extends across the switch cavity and operates to close the cavity. The outer end of such terminal member provides the terminal for the movable contact. The movable contact itself is provided by a thin flexible element which engages the terminal member and is provided with a projection fitting into an opening in the terminal member a substantial distance from the mounting rivet.

A single mounting rivet extends through the terminal member and flexible member and operates to secure them in tight contact to provide a good electrical connection therebetween. The rivet also secures the movable contact assembly against an insulating spacer which in turn holds the fixed contact against the mounting portion of the body. With this structure, all of the switch elements are secured in position by a single rivet.

The inner end of the fixed contact is positioned in a locating recess in the switch body at a location substantially spaced from the rivet. Therefore, dimensional variations in the locating recess have a minimum effect on the position of the fixed contact with respect to the body. Similarly, the inner end of the terminal member is positioned by opposed walls in the body at a location substantially spaced from the rivet. Here again, this minimizes the affect of dimensional variations of the body on the position of the terminal member.

The flexible movable contact is positioned with respect to the terminal so that the proper position of the terminal member with respect to the body also insures proper positioning of the flexible contact element.

The terminal member is provided with a shallow dished shape projection around the rivet which is pulled in or prestressed by the rivet to function as a tensioning spring. This insures that the switch elements are tightly maintained in their proper mounted position even at elevated temperatures so that differential expansion of the parts of the thermostat does not cause looseness of the switch element.

DETAILED DESCRIPTION OF THE DRAWINGS

Figure 2:
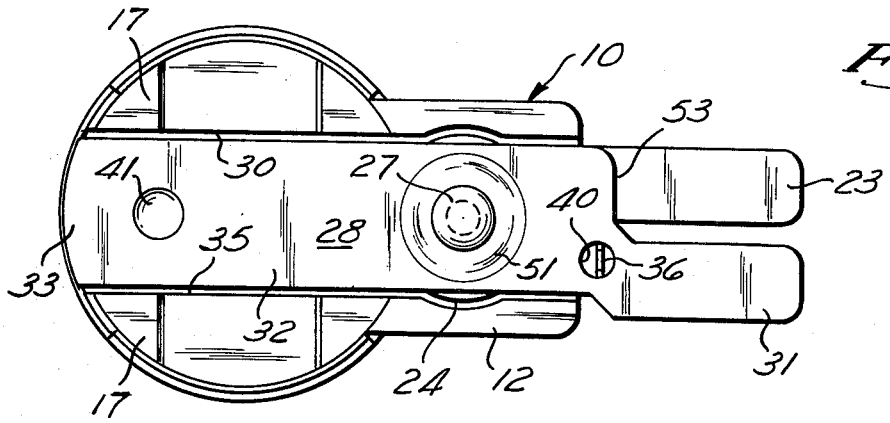
FIG. 2 is a plan view of the thermostat illustrated in FIG. 1.
Figure 1:
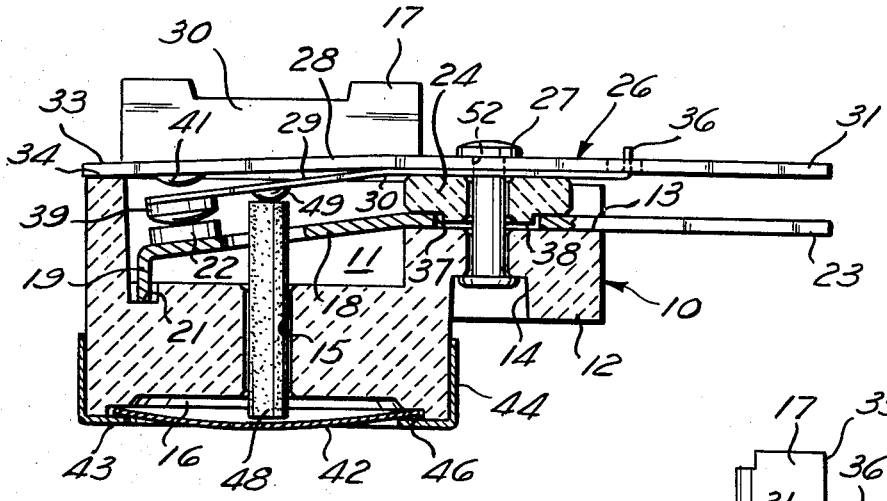
FIG. 1 is a side elevation in longitudinal section illustrating the general arrangement of the switch and the mounting therefor.

In the illustrated embodiment of this invention, a ceramic body 10 is provided with a generally rectangular switch cavity 11 and a mounting portion 12 extending from one end thereof. The mounting portion 12 is provided with a flat mounting surface 13 and a recessed rivet opening 14. Along the lower surface (as viewed in the drawings), the body 10 is formed with a shallow disc recess 16 with a bumper guide opening 15 extending from the recess 16 through the body to the switch cavity 11. A pair of mounting extensions 17 extend upwardly on opposite sides of the switch cavity 11.

An elongated fixed contact support 18 is positioned against the mounting surface 13 and extends to an inner end having a lateral projection 19 which is positioned in a locating recess 21 formed in the body 11. A fixed contact 22 is welded to the fixed contact support 18 adjacent to the lateral projection 19. The outer end of the fixed contact support extends exteriorly of the body to provide one of the terminals 23 of the switch.

Positioned immediately against the upper side of the fixed contact support 18 is an insulator spacer 24 which is also formed of ceramic material. A movable contact assembly 26 is secured against the upper surface of the spacer 24 by a rivet 27 which functions to secure all of the switch parts and spacer 24 to the body 10. In order to insure that the fixed contact support arm 18 is spaced from the rivet and yet properly located with respect to the mounting surface 13, it is formed with a relatively large diameter opening 37 which receives an annular projection 38 on the rivet.

The movable contact assembly 26 includes two parts: an elongated terminal and closure member 28 and a flexible contact support 29. The terminal member 28 is provided with a terminal portion 31 extending outwardly of the mounting portion 12 and a cover portion 32 which extends across and closes the switch cavity 11. The end 33 of the terminal member 28 is positioned vertically by its engagement with the body surface 34 and is laterally positioned between the opposed walls 30 and 35 of the mounting projections 17.

The flexible contact support arm 29 extends between the spacer 24 and the terminal member 28 and is held in tight engagement therewith by the rivet 27 so that a good electrical contact is provided. Outwardly of the rivet 27, the flexible contact support arm is formed with an upstanding tab 36 which extends upwardly through an opening 40 in the terminal member 28 to cooperate with the rivet 27 to maintain its exact orientation between the arm 29 and the terminal member 28.

A bend at 30 is formed in the support arm 29 so that it diverges from the member 28 to its inner end. The movable contact 39 is welded to the free end of the flexible contact support arm 29 and is movable into and out of engagement with the fixed contact 22 to provide the switching action. The terminal and cover member 28 is formed with a dimple 41 to limit upward travel of the movable contact when the switch is open.

Figure 3:
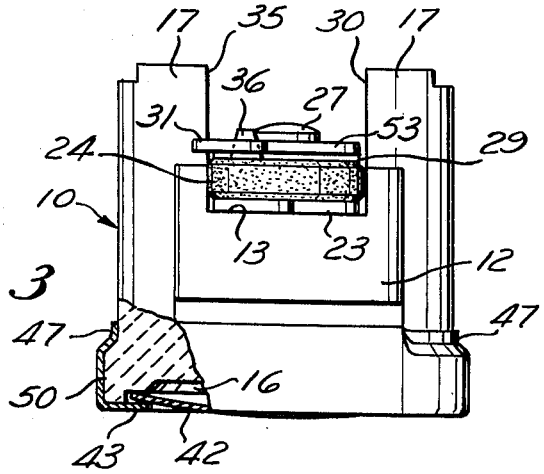
FIG. 3 is a terminal end view of the thermostat of FIGS. 1 and 2.

A bimetal snap disc 42 is secured in the disc recess 16 by a disc cap 43. The disc cap 43 provides an inwardly extending shoulder 44 which positions the periphery of the disc in cooperation with a shallow step 46 formed in the body 10. As best illustrated in FIG. 3, the disc cap is bent in at opposite sides 47 over a projection 50 formed in the body 10 to secure the disc cap in its assembled position.

A cylindrical bumper 48 is guided in the opening 15 and is engageable at its lower end with a center portion of the disc 42 and at its upper portion with a dimple 49 formed in the flexible contact support arm 29. The length of the bumper 48 is arranged to provide slight clearance when the disc 42 is in the position illustrated and the contacts are closed. This insures that the disc is in snap movement before the contacts are open.

Figure 4:
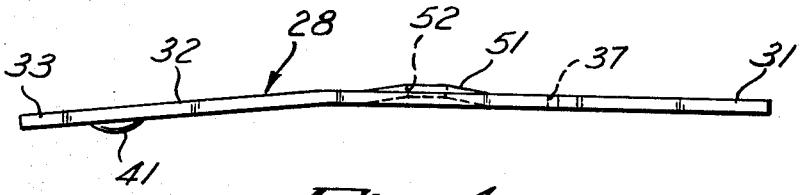
FIG. 4 illustrates the terminal member part of the movable contact assembly prior to its mounting in the assembled thermostat.

Referring to FIG. 4, the terminal member and cover 28 is formed with a shallow dished shaped projection 51 around the opening 52 through which the rivet projects. During the assembly and riveting operation, the rivet 27 pulls the dished shaped projection 51 downwardly substantially into the plane of the member to prestress the assembly and provide a spring action which insures that the switch parts do not become loose even at relatively elevated temperatures. Consequently, differential expansion between the metal and ceramic parts does not cause looseness of any of the switch parts even when the device is exposed to relatively high temperatures.

The switch mounting structure is arranged for simplicity of assembly while providing the very good positioning of the switch elements even when the body 10 is formed of a ceramic material which cannot be maintained at extremely close tolerances. The rivet 27 locates the center portion of each of the switch elements with respect to the body mounting portion 12 against all movement other than movement around the axis of the rivet. The fixed contact support 18 is locked against such movement around the rivet axis by the projection 19 which fits into the recess 21. Since there is a substantial spacing between the rivet 27 and the projection 19, any looseness of the fit between the projection 19 and the recess 21 will permit a minimum of movement around the rivet axis. Similarly, the location of the end 33 of the terminal and cover member 28 at a point substantially spaced from the rivet 27 insures a minimum rotational movement around the rivet axis created by looseness resulting from manufacturing tolerances. Further, such structure provides sufficient strength to withstand substantial forces applied to the terminals. Finally, the position between the flexible contact arm 29 and the terminal and cover member 28 is maintained by the tab 36 at a point substantially spaced from the rivet 27 to insure proper positioning of the two parts of the movable contact assembly.

Preferably, the terminal portion 31 of the terminal member 28 is offset from the terminal portion 23 of the fixed contact support as best illustrated in FIG. 2. This offset provides a step or lateral wall 53 which is preferably located outwardly from the projection 36 so that connecting of the terminal portion to a mating terminal will not result in contact of such mating terminal part with the tab 36.

Although the illustrated embodiment utilizes a ceramic body 10, insulating spacer 24, and bumper 48, it should be understood that this thermostat structure can also be fabricatd utilizing conventional plastic materials instead of ceramic material. However, the use of ceramic materials permits the device to be used in higher temperature environments.

The assembly of the thermostat is, of course, easily accomplished. To assemble the switch, it is merely necessary to position the switch elements and the spacer 24 on the body and to rivet them in position to complete the assembly of the entire switch system in a single operation. The disc and bumper are then installed and held in position by a disc retaining cup 43 which is rolled over a body projection to secure it in a permanently mounted condition. Manufacturing economies are also realized by the fact that the various component parts of the device are easily manufactured because of their structurally simple shape.

Although a preferred embodiment of this invention is illustrated it is to be understood that various modifications and rearrangements may be resorted to without departing from the scope of the invention disclosed and claimed.

What is claimed is:

1. A thermostat or the like comprising a body providing a switch cavity and a switch mounting portion on one side thereof, a switch including fixed contact means and movable contact means, said movable contact means including a movable contact and a terminal member, a single rivet securing both contact means to said body, said body and said contact means each providing interengaging locating surfaces substantially spaced from said rivet cooperating with said rivet to prevent relative movement between said body and contact means, and a condition-sensitive snap device mounted on said body and connected to operate said contact means, one of said contact means closing said cavity, and said interengaging locating surfaces being on the side of said cavity remote from said rivet one of said contact means including spring means prestressed by said rivets and operating to prevent looseness of said switch when a temperature of said thermostat changes, and said condition-sensitive snap device being a bimetal snap disc.

2. A thermostat or the like as set forth in claim 1 wherein said spring means is a shallow dished form provided in one contact means around said rivet.

3. A thermostat or the like as set forth in claim 2 wherein said body is ceramic material, and a ceramic spacer is positioned between said contact means to electrically insulate them.

4. A thermostat or the like as set forth in claim 3 wherein said movable contact means includes a terminal and cover member enclosing said cavity, providing a terminal portion exterior of said body and providing said dished form.

5. A thermostat or the like as set forth in claim 4 wherein said movable contact means includes a spring contact support arm cantilever mounted against said terminal and cover member by said rivet, said spring contact support arm extending inwardly across said switch cavity.

6. A thermostat or the like as set forth in claim 5 wherein said dished form is engaged by the end of said rivet remote from said mounting portion.

7. A thermostat or the like comprising a body providing a switch cavity and a switch mounting portion on one side thereof, a switch including fixed contact means and movable contact means, a single rivet securing both contact means to said body, said body and said contact means each providing interengaging locating surfaces substantially spaced from said rivet cooperating with said rivet to prevent relative movement between said body and contact means, a condition-sensitive snap device mounted on said body and connected to operate said contact means, said movable contact means includes a member formed with a shallow dished projection around said rivet and engaged by the end of said rivet remote from said mounting portion, said dished projection being prestressed by said rivet to prevent looseness of said switch when the temperature of said thermostat changes.

8. A thermostat or the like comprising a body providing a switch cavity and a terminal support portion adjacent thereto, an elongated fixed contact projecting across said support portion into said cavity at one end and providing a terminal portion exterior of said body at its other end, a movable contact assembly including an elongated terminal member providing a terminal portion exterior of said body and a cover portion extending across and closing said cavity, said movable contact assembly also including a flexible arm having a mounting portion engaging said terminal member and a cantilever portion spaced from said terminal member, said cantilever portion being movable into and out of engagement with said fixed contact, and insulating spacer between said fixed contact and said movable contact assembly, a single rivet extending through said movable contact assembly, said insulator and said fixed contact securing them to said body, one of said fixed contact or said movable contact assembly providing a shallow offset section around said rivet which is deformed from its unstressed position by said rivet to prevent looseness from occurring, a bimetal snap disc on said body, and a bumper operable to move said cantilever portion into and out of engagement with said fixed contact.

9. A thermostat comprising a body assembly providing a switch cavity, a switch in said cavity, said switch including at least one contact secured to said body assembly by a rivet or the like, and temperature responsive means on said body assembly operable to open and close said switch in response to temperatures sensed thereby, said one contact including spring means prestressed by said rivet or the like and operating to prevent looseness of said switch when the temperature of said thermostat changes.

* * * * *